US008525429B2

(12) United States Patent
Schlenk et al.

(10) Patent No.: US 8,525,429 B2
(45) Date of Patent: Sep. 3, 2013

(54) METHOD FOR CONTROLLING GAS DISCHARGE LAMPS

(75) Inventors: Manfred Schlenk, Augsburg (DE); Robert Weger, Wels (AT); Hans Hoffmann, Augsburg (DE); Mykhaylo Raykhman, Munich (DE); Michael Herfurth, Gilching (DE); Martin Feldtkeller, Munich (DE)

(73) Assignee: Minebea Co., Ltd., Nagano-Ken (JP)

( * ) Notice: Subject to any disclaimer, the term of this patent is extended or adjusted under 35 U.S.C. 154(b) by 317 days.

(21) Appl. No.: 12/820,219

(22) Filed: Jun. 22, 2010

(65) Prior Publication Data

US 2010/0327771 A1 Dec. 30, 2010

(30) Foreign Application Priority Data

Jun. 22, 2009 (DE) ..... 10 2009 030 106

(51) Int. Cl.
*H05B 37/02* (2006.01)

(52) U.S. Cl.
USPC ..... 315/224; 315/219; 315/307; 315/308

(58) Field of Classification Search
USPC ..... 315/291, 307, 308, 224, 209 R, 219, 315/220, 221, 223, 246, 247, DIG. 5, DIG. 6
See application file for complete search history.

(56) References Cited

U.S. PATENT DOCUMENTS

| | | | | |
|---|---|---|---|---|
| 7,081,709 | B2 * | 7/2006 | Pak | 315/101 |
| 7,154,232 | B2 | 12/2006 | Contenti | |
| 7,312,582 | B2 * | 12/2007 | Newman et al. | 315/200 R |
| 7,781,987 | B2 * | 8/2010 | Cheng et al. | 315/307 |
| 2006/0197470 | A1 | 9/2006 | Ribarich | |

FOREIGN PATENT DOCUMENTS

| | | |
|---|---|---|
| DE | 60006046 | 5/2004 |
| EP | 1776000 | 4/2007 |
| WO | 2007 000684 | 1/2007 |

* cited by examiner

*Primary Examiner* — David H Vu
(74) *Attorney, Agent, or Firm* — Cooper & Dunham LLP

(57) ABSTRACT

A method and a device for controlling gas discharge lamps using a direct current/alternating current inverter (DC/AC inverter) that is operated at a predetermined frequency and that generates an AC output voltage U for operating the gas discharge lamps from a DC input voltage which has a residual ripple.

The DC/AC inverter is operated in zero voltage switching (ZVS) mode, wherein the DC input voltage is used as the control variable for the lamp current $I_L$, wherein fluctuations in the lamp current $I_L$ caused by the residual ripple of the DC input voltage are compensated by a variation in the switch-on times and/or switch-off times of the switching elements $Q_H$, $Q_L$ of the DC/AC inverter.

6 Claims, 5 Drawing Sheets

METHOD FOR CONTROLLING GAS DISCHARGE LAMPS

The invention relates to a method for controlling gas discharge lamps, particularly an amalgamation of gas discharge lamps for backlighting an LCD display. These kinds of LCD displays are used, for example, in televisions or as computer screens.

PRIOR ART

A known method for realizing the backlighting in LCD displays is to use gas discharge lamps that are operated at a voltage of 500 to 1500 V. In the future, the system power supply and light converters for LCD televisions will be integrated together on LIPS (lighting power supply) boards. A LIPS board substantially consists of an input stage for power factor correction (PFC input stage), a flyback converter that supplies the audio and video circuits of the television and a DC/AC inverter that supplies the gas discharge lamps and ensures reliable electrical isolation via an isolating transformer. The power switches of the DC/AC inverter are hard switching and do not produce any considerable switching losses. As part of the development of energy-saving devices, efforts are being made to reduce such losses.

The cause of lossy switching in power switches can be attributed to the contemporary control principle. Known inverters operate at a constant working frequency and input voltage. Lamp power or lamp currents can therefore only be regulated by varying the duty cycle of the power switch. Due to the large variations in switch-on time required, the power switches can only be hard switching.

WO 2007/000684 A1 discloses a switch for controlling gas discharge lamps in which the lamp current is regulated by changing the input voltage of the DC/AC inverter.

SUMMARY OF THE INVENTION

It is the object of the invention to provide a method for controlling gas discharge lamps that regulates the lamp current such that homogeneous lighting can be maintained. Moreover, variations in temperature and external interfering signals that influence the lamp current are to be compensated.

Preferred embodiments of the invention are cited in the subordinate claims.

The method provides a particularly low-loss control for gas discharge lamps and contains means of actively and passively damping interfering signals.

According to the invention, the power switches of the DC/AC inverter are operated using the ZVS (zero voltage switching) technique in order to increase energy efficiency. Here, the switches are switched on when voltage-free, i.e. switched at a time when the voltage across them is zero. This, however, has the consequence that the switch-on time of the power switches can no longer be used for regulating the lamp current. It can be varied within a range of several percent, but has to be selected such that the ZVS operation sets in.

This means that the usual method for regulating the current through variation to the duty cycle (PWM) is no longer available. Regulating the lamp current has then to be effected either by using the operating frequency or by using the input voltage across the inverter. The first variant has to be eliminated because of the choice of a fixed operating frequency. A fixed operating frequency is preferred so as to avoid any possible interference between the working frequency of the light converter and the line frequency of the television. The output voltage of the upstream power factor correction stage (PFC stage) is therefore used as the control variable for the lamp current. This PFC output voltage is increased or decreased as a function of the lamp current until the desired value for the lamp current is achieved. Since the lamp current changes according to the operating temperature, the PFC output voltage has also to be tracked according to temperature.

PFC stages do not generate an ideal DC voltage, but rather a residual ripple remains, i.e. the output voltage of the PFC stage is superimposed by an AC voltage (100 Hz to 120 Hz) of approx. 5% to 10% of the DC output voltage. These voltage fluctuations can then be found again in the lamp current or as a flicker in the lamp brightness. In order to reduce the residual ripple to less than 1%, according to the invention the current control circuit is superimposed by another control circuit that allows partial stabilization of the residual ripple of the PFC output voltage via a variation in the switch-on time of the power switches. The switch-on time of the power switches may, however, only be changed to the extent that the ZVS operation is maintained. This usually makes it possible for the residual ripple value to be reduced by approx. 2%-3%. To achieve the desired reduction of <1%, according to the invention the leakage inductance of the lamp transformer is increased until the required damping occurs.

Audio signals having a very low frequency (bass) could have a further influence on t stability of the supply voltage of the lamps. At very high volume levels, they produce changes in the PFC output voltage at a frequency of some 10 Hz that cannot be compensated at the PFC stage and that can affect the lamp current. To prevent this, according to the invention a further control circuit is implemented and superimposed on the PFC controller circuit. Normally, the control circuit of a PFC stage is designed for very slow changes in the PFC output voltage. In the regulating method presented here, the PFC current or the PFC output voltage is monitored for unexpected deviations via a current- or a voltage-actual-value input of the PFC stage of the control circuit. Should such deviations be ascertained, according to the invention the dynamic of the PFC control circuit is changed and the change in load is quickly counteracted.

DESCRIPTION OF A PREFERRED EMBODIMENT OF THE INVENTION

Figure 1:
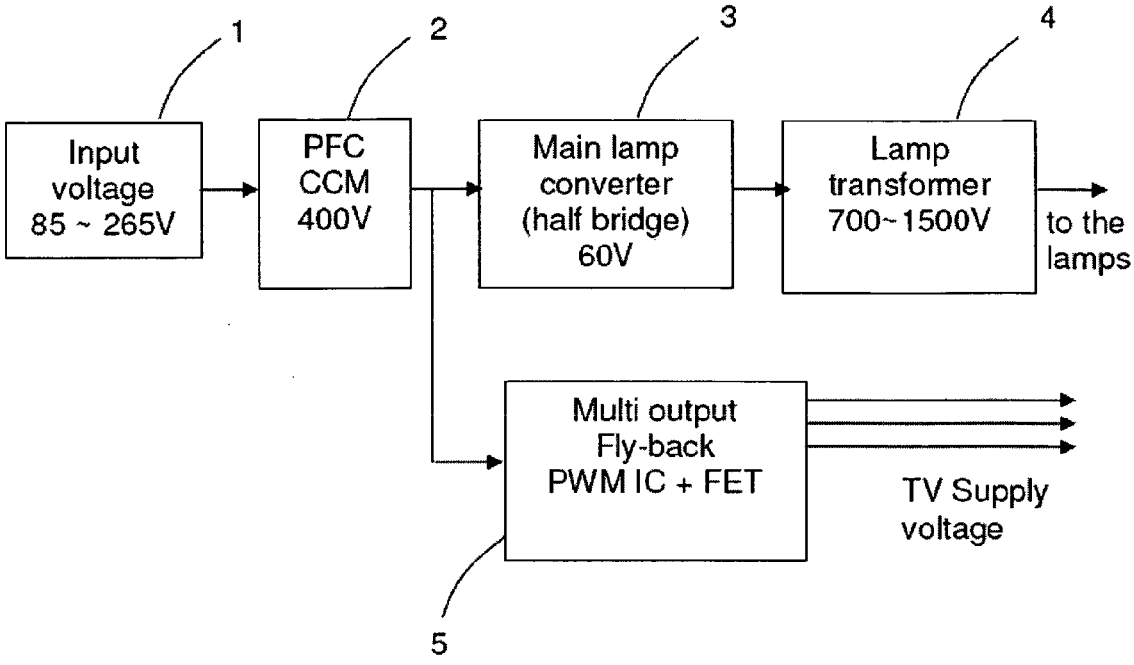
FIG. 1: shows a block diagram of a circuit for controlling gas discharge lamps and other loads.

FIG. 1 shows a block diagram of the circuit for controlling gas discharge lamps according to the invention. The circuit has an input stage 1 that generates an input voltage of 85 to 265 volts DC current. This input voltage is generated from conventional mains voltage by means of rectification. The input voltage is fed to a power factor correction stage 2 in which a power factor correction (PFC) is implemented. The power factor correction preferably takes place on the boundary between discontinuous and continuous conduction mode (CCM: critical conduction mode). The output voltage of the power factor correction stage 2 is about 400 volts, which is then fed to a lamp converter 3. The lamp converter 3 is designed as a direct current/alternating current inverter (DC/AC inverter) having a half-bridge circuit. The half-bridge circuit of the lamp converter 3 drives a lamp transformer 4 that transforms the primary voltage that is supplied by the lamp inverter 3 into a secondary voltage of 700 to 1500 volts with which the gas discharge lamps 6 are then operated. The output voltage of the power factor correction stage 2 is simultaneously fed to a flyback converter 5 that generates one or more output voltages that are needed for the power supply of further units.

Figure 2:
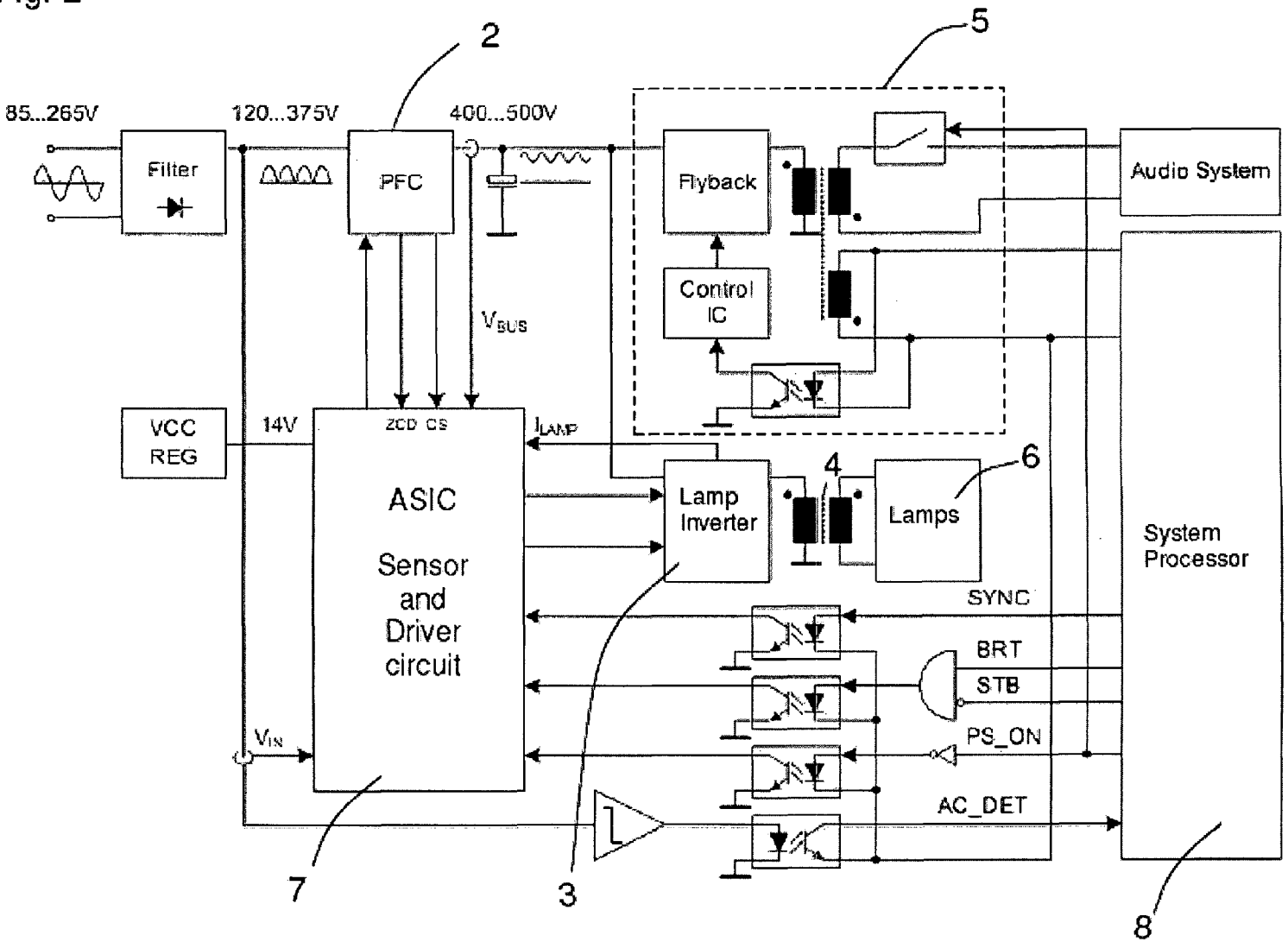
FIG. 2: shows an extended block diagram of the overall system.

FIG. 2 shows a detailed block diagram of the overall system. Recognizable on the left is the input circuit 1 for generating a DC input voltage of 120 to 375 volts for the converter from the mains voltage of 85 to 265 volts. This input voltage is fed into the power factor correction stage 2 in which power factor correction is carried out and a DC output voltage of approximately 400 to 500 volts is generated for supplying the lamp converter 3 as well as the flyback converter 5. The flyback converter 5 generates several output voltages that are used to supply power to the circuit components or other components such as the audio system. The lamp converter 3 is connected to the gas discharge lamps 6 to be supplied via the transformer 4. The power factor correction stage 2 and the lamp converter 3 are monitored and controlled by an integrated control circuit 7 that detects appropriate sensor signals and determines control signals from these that are fed to the electronic components. A system processor 8 controls and regulates the overall circuit arrangement and, for example, allows dimming of the lamp circuit, adjustable by the user. For this purpose, the system processor 8 generates various output signals that, galvanically isolated via an optocoupler, are fed to the control circuit 7 that generates appropriate control signals for controlling the respective components.

Figure 3:
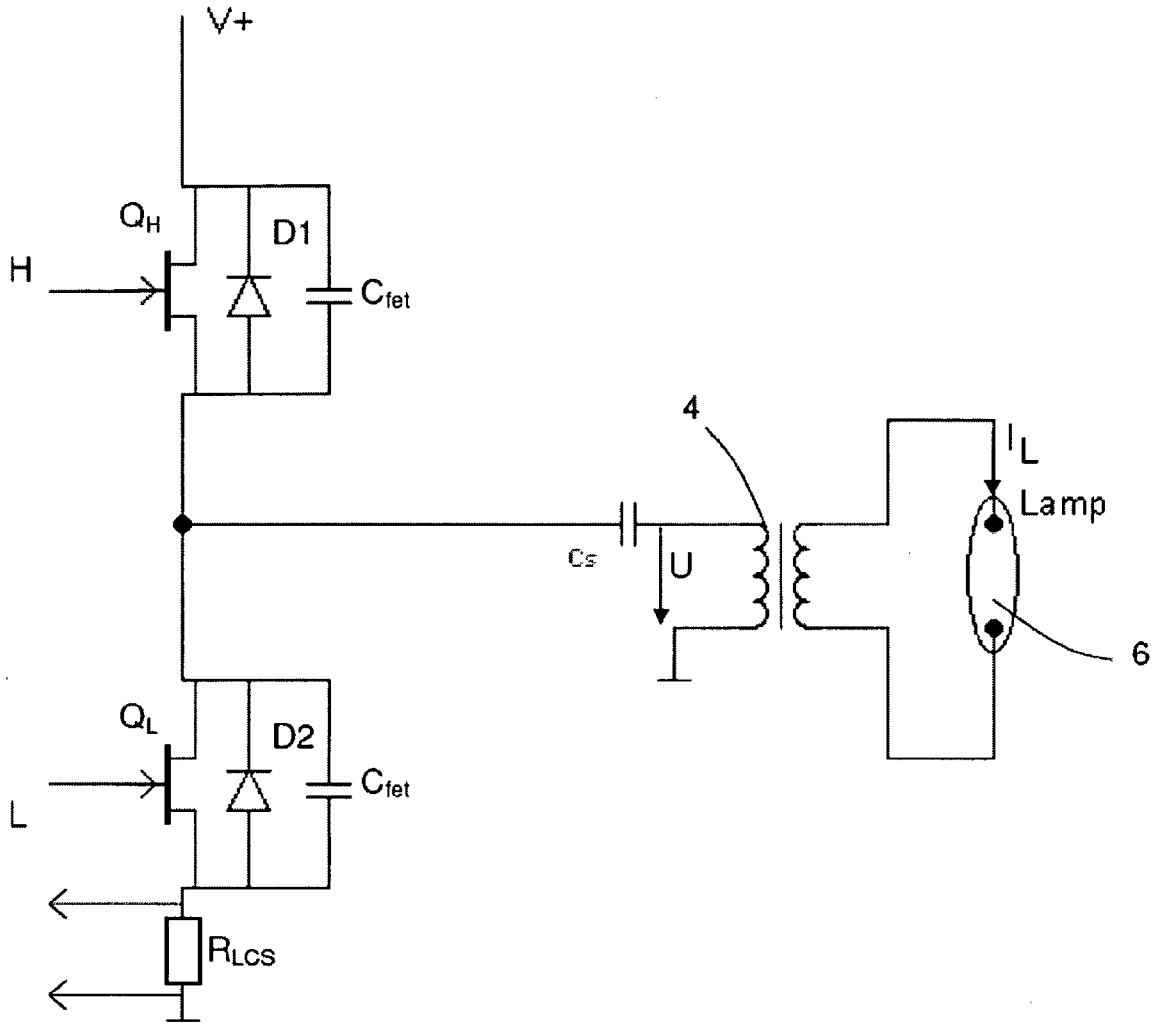
FIG. 3: schematically shows the circuit of the lamp converter that supplies the lamps via a transformer.
Figure 4:
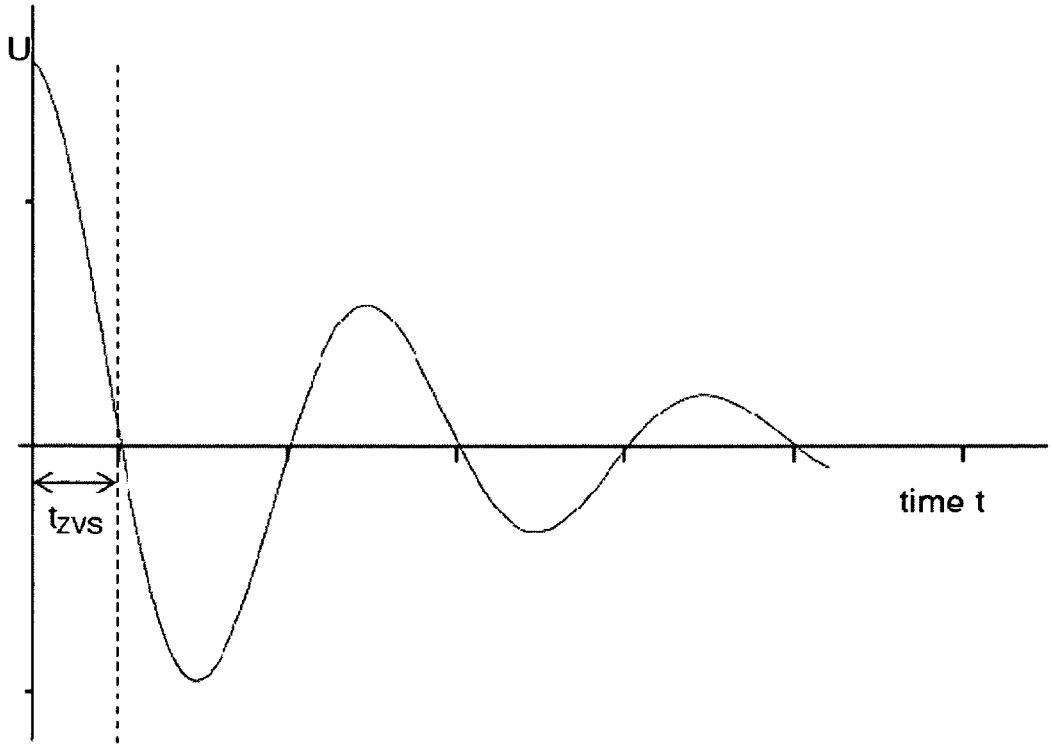
FIG. 4: schematically shows the voltage flow in the oscillating circuit of the lamp converter during the pauses of the power switches.

FIG. 3 schematically shows that the lamp converter comprises a half-bridge circuit that consists of two power switches $Q_H$ and $Q_L$ which are connected via a coupling capacitor $C_S$ to the primary winding of the transformer 4. The gas discharge lamps 6 are supplied via a secondary winding of the transformer 4. The two power switches $Q_H$ and $Q_L$ are switched alternately so that the left terminal of the capacitor $C_s$ is connected alternately to the supply voltage V+ and ground. Typical switching frequencies are approx. 40 KHz. The capacitor $C_S$ and the parasitic capacitors $C_{fet}$ of the power switches $Q_H$ and Q, together with the primary winding of the transformer 4, form a series resonant circuit that is tuned to the switching frequency of the power switches. In this series resonant circuit, an approximately sinusoidal alternating current begins to build up that is transformed by the transformer 4 and supplies the lamps 6. When the capacitor $C_S$ is connected to the supply voltage V+, a magnetic field is formed in the primary coil of the transformer 4. When the capacitor $C_S$ is connected to ground, the magnetic energy stored in the coil induces a decaying sinusoidal oscillation in accordance with FIG. 4. The power switches $Q_H$, $Q_L$ contain parasitic diodes D1 and D2. When the power switches are switched off, current flows across these parasitic diodes D1 or D2. This leads to switching losses in the discharge circuit since the parasitic diodes D1, D2 switch relatively slowly and are lossy. Although it is possible to operate external, fast-switching diodes parallel to these parasitic diodes, this is expensive and still subject to loss.

In order to eliminate these switching losses to a large extent, the half-bridge is operated according to the voltageless switching method also known as zero voltage switching (ZVS). By far the largest proportion of switching losses occurs in the event of high operating voltages when the power switches are switched on. According to the invention, the power switches are thus switched on when the voltage of the series resonant circuit of the converter has zero crossing. This occurs in FIG. 4 at time $t_{ZVS}$. This voltageless switching of the power switches $Q_H$ and $Q_L$ makes it possible for switching losses to be reduced considerably.

However, this voltageless switching means that the switch-on time of the power switches $Q_H$ and $Q_L$ cannot be freely selected, but is substantially predetermined. Only slight variations to a maximum of approx. 5% are possible.

Figure 5:
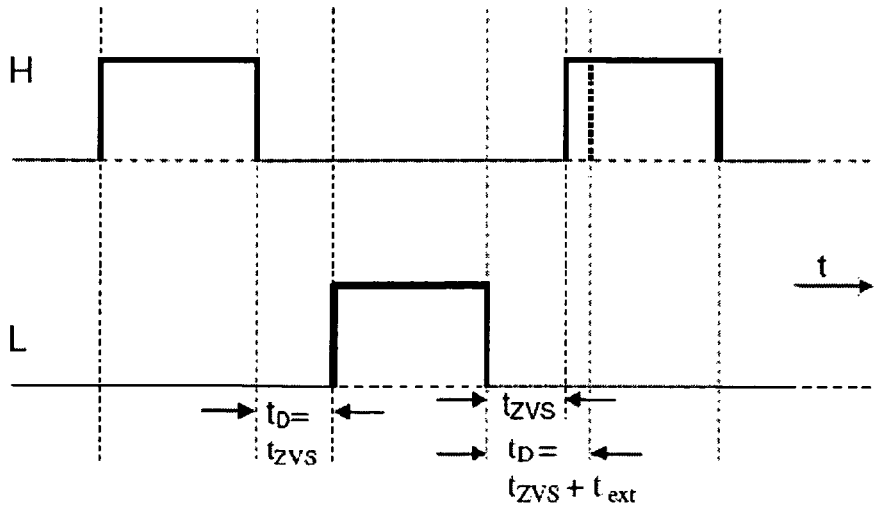
FIG. 5: schematically shows the control signals for controlling the power switches of the lamp inverter.

FIG. 5 shows the control signals of the power switches respectively: control signal H for power switch $Q_H$ and control signal L for power switch $Q_L$. The power switches are switched on alternately, a dead time $t_D$ being maintained between the switching times. The dead time $t_D$ allows for the on/off switching delay of the power switches and ensures that both power switches are never conductive at the same time. Switching on the power switches $Q_H$ or $Q_L$ takes place at time $t_{ZVS}$ at which the voltage in the oscillating circuit has zero crossing. Also the signal L for the switch $Q_L$ is switched on at time $t_{ZVS}$ after the switch $Q_H$ has been switched off. The dead time $t_D$ is provided between the respective duty cycles. This dead time $t_D$ thus corresponds to the time period $t_{ZVS}$. The respective duty cycle of the two power switches must be of equal length, otherwise the transformer would be operated asymmetrically.

A problem is that the input voltage for the lamp inverter 3, i.e. the output voltage of the power factor correction stage 2, is not a pure DC voltage but rather has a residual ripple that corresponds to double the mains frequency (i.e. 100 Hz or 120 Hz). This residual ripple of 100 or 120 Hz can be up to 5% and is transferred through the lamp inverter 3 to the lamps 6, whose lamp current is thereby changed and consequently the brightness of the lamps in the respective frequency. In order to compensate for these changes in current in the lamp or fluctuations in brightness, provision is thus made according to the invention for the duty cycle of the respective power switch to always be shortened when the residual ripple or ripple voltage is positive, i.e. is above the setpoint value of the output voltage of the PFC stage 2. This is achieved by a slight variation in the switch-on time or alternatively in the switch-off time within the scope of up to 5% as a function of the input voltage of the lamp inverter 3. For example, the dead time $t_D$ is extended by an additional time period $t_{ext}$ and as a result the respective duty cycle of the power switches is decreased. An amplitude modulation of the primary voltage of the transformer 4 is thereby achieved that is in opposition to the phase of the ripple voltage, i.e. the residual ripple of the input voltage of the lamp inverter. Consequently, the residual ripple or ripple voltage is substantially compensated.

Further reduction of residual ripple can be achieved by increasing the leakage inductance of the transformer 4 or by an inductance that is connected in series to the primary winding of the transformer. In order to implement this regulating procedure, the current in the oscillating circuit of the lamp inverter 3 or the lamp current is measured by the control circuit 7 and the power switches $Q_H$ and $Q_L$ are then activated accordingly.

Particularly in LCD televisions, high-performance built-in audio systems could also cause low-frequency audio signals of the input voltage of the lamp converter 3 to be overlaid. These ripple voltages give rise to a residual ripple in the lamp voltage and thus a low-frequency current change in the lamp current, which is reflected in visible fluctuations in brightness.

To prevent this, according to the invention a further control circuit is implemented in the control circuit 7 and superimposed on the PFC controller circuit. The PFC current or the PFC output voltage is monitored for unexpected deviations via a current- or a voltage-actual-value input of the PFC stage of the control circuit. Should such be detected, according to the invention the dynamic of the PFC control circuit is changed and the change in load rapidly counteracted.

Figure 7:
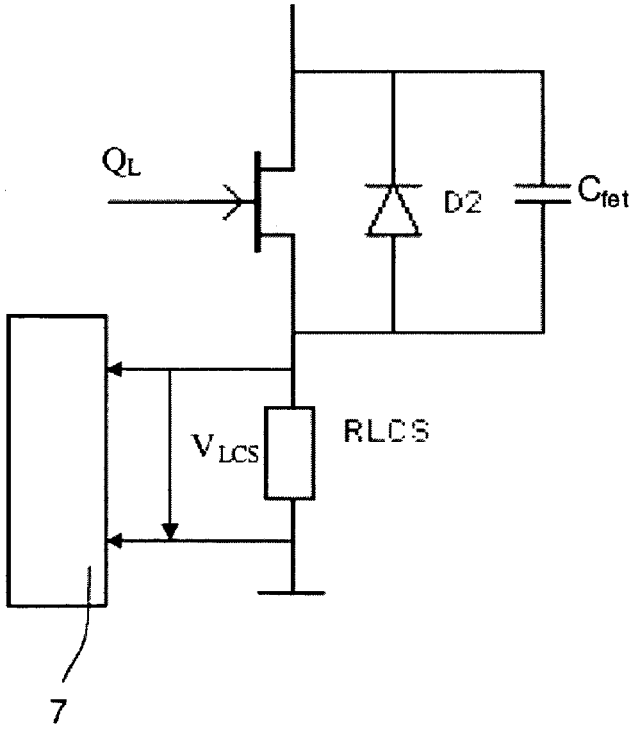
FIG. 7: schematically shows a circuit for measuring the lamp current.

The measurement of the effective lamp current is made by the control circuit 7, preferably in the primary circuit of the transformer 4. As illustrated schematically in FIG. 7, the current measurement can be effected using a resistor $R_{LCS}$ at the ground-side terminal of the power switch $Q_L$. The voltage drop $V_{LCS}$ across the resistor $R_{LCS}$ is measured and evaluated by the control circuit 7. By measuring the voltage $V_{LCS}$ or the lamp current (by multiplying the measured voltage by the resistor value $R_{LCS}$), excessive current flows i.e. short circuits on the primary or secondary side, can be identified. At the same time, a current limiting circuit may be realized. The lamp current is additionally controlled by this.

It is important to note that in the times $T_P$ in which the power switch $Q_L$ is switched off, there is no measurement of the voltage $V_{LCS}$ or the current. Hence, according to the invention, a sample-and-hold amplifier for internal storage of the momentary measured value is used. This sample-and-hold amplifier is integrated in the control circuit 7.

Figure 6:
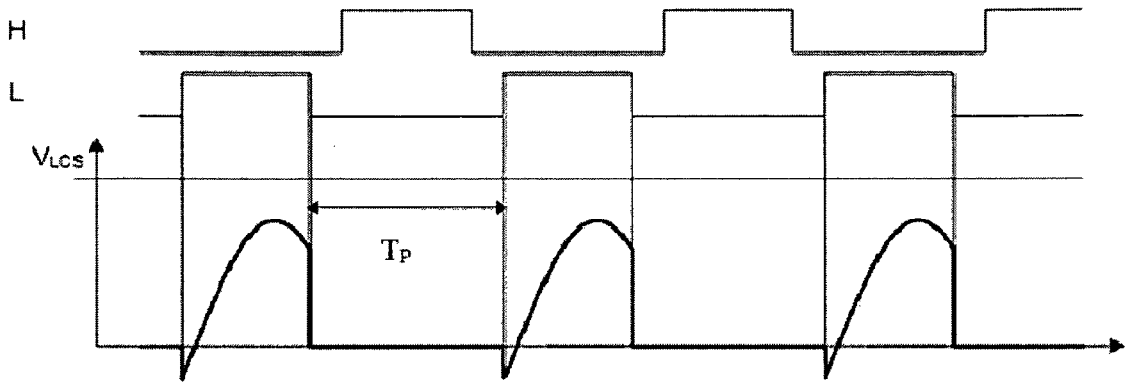
FIG. 6: schematically shows the voltage diagram of the drive signal for the power switches as well as the voltage on the primary coil of the transformer.

In FIG. 6, the control signals of the switches QH and QL are illustrated as well as the voltage flow $V_{LCS}$ during several measuring cycles.

According to the invention, the current through the lamps 6 is regulated (constant lamp current) in order to maintain homogeneous lighting. In doing so, variations in temperature and external interfering signals have to be compensated. This regulation is assumed by the control circuit 7 that controls the half-bridge of the lamp inverter 3, consisting of the power switches $Q_H$ and $Q_L$.

The working frequency f of the lamp inverter is predetermined and should not be varied. The input voltage of the lamp converter 3 is thus used as the control variable for the lamp control. In order to operate the half-bridge with the lowest possible loss, zero voltage switching (ZVS) is applied, i.e. the power switches are activated at the exact time that the voltage which lies across the power switch in the freely oscillating mode of the oscillating circuit, has zero crossing. By a slight variation in the switching time around and about the optimum switch-on time $t_{ZVS}$, the residual ripple of the input voltage of the lamp converter 3 can be compensated.

Moreover, passive damping of the residual ripple can be realized through an increase in leakage inductance (4% to approx. 15%) on the primary side of the transformer 4, or an additional coil or an appropriate transformer design.

IDENTIFICATION REFERENCE LIST

| | |
|---|---|
| 1 | Input stage |
| 2 | Power factor correction stage |
| 3 | Lamp converter |
| 4 | Transformer |
| 5 | Flyback converter |
| 6 | Lamp(s) |
| 7 | Control circuit |
| 8 | Processor |
| U | Voltage in oscillating circuit |
| $I_L$ | Lamp current |
| $Q_H$ | Power switch |
| $O_L$ | Power switch |
| $C_S$ | Isolating capacitor |
| D1, D2 | Parasitic diode |
| $C_{fet}$ | Parasitic capacitor |
| $R_{LCS}$ | Measuring resistor |
| $V_{LCS}$ | Voltage across the measuring resistor |
| H, L | Control signal for the power switch |
| $t_{ZVS}$ | Switching time for zero point switching |
| $t_D$ | Dead time |
| $t_{ext}$ | Switching time variation |

The invention claimed is:

1. A method for controlling gas discharge lamps (6) using a direct current/alternating current inverter (DC/AC inverter) (3) that is operated at a predetermined frequency and that generates an AC output voltage U for operating the gas discharge lamps from a DC input voltage which has a residual ripple, comprising operating the DC/AC inverter (3) in zero voltage switching (ZVS) mode, using the DC input voltage as the control variable for the lamp current $I_L$, and compensating for fluctuations in the lamp current $I_L$ caused by the residual ripple in the DC input voltage by a variation in the switch-on times and/or switch-off times of the switching elements $Q_H$, $Q_L$ of the DC/AC inverter (3).

2. A method according to claim 1, comprising transforming the AC output voltage U of the DC/AC inverter (3) by a transformer (4) to a required voltage for operating the gas discharge lamps (6), wherein fluctuations in the lamp current $I_L$ caused by the residual ripple in the DC input voltage are reduced by an increase in the leakage inductance of the transformer (6) or an additional inductive component connected in series with the primary winding of the transformer (6).

3. A method according to claim 1, comprising implementing and superimposing a further control circuit on the PFC controller circuit, monitoring the PFC current or the PFC output voltage for unexpected deviations using a current- or a voltage-actual-value input of the PFC stage of the control circuit, and, if required, changing the dynamic of the PFC control circuit such that the change in load is counteracted.

4. A method according to claim 1, characterized in that the lamp current $I_L$ flowing through the gas discharge lamps (6) is only measured during the switch-on time of a power switch $Q_L$ and that the measured value is temporarily stored during switch-off times.

5. A method according to claim 1, characterized in that the DC/AC inverter (3) is designed as a half-bridge circuit.

6. A device for controlling gas discharge lamps (6) that comprises a direct current/alternating current inverter (DC/AC inverter) (3) which is operated at a predetermined frequency and that generates an AC output voltage U for operating the gas discharge lamps from a DC input voltage which has a residual ripple, characterized in that the DC/AC inverter (3) operates in zero voltage switching (ZVS) mode, wherein the DC input voltage is used as the control variable for the lamp current $I_L$, wherein fluctuations in the lamp current $I_L$ caused by the residual ripple of the DC input voltage are compensated by a variation in the switch-on times and/or switch-off times of the switching elements $Q_H$, $Q_L$ of the DC/AC inverter (3).

* * * * *